US011939109B2

(12) United States Patent
Kaneko

(10) Patent No.: US 11,939,109 B2
(45) Date of Patent: Mar. 26, 2024

(54) SHOCK-ABSORBING STRUCTURE AND TRANSPORTATION PALLET

(71) Applicant: FUJIFILM Business Innovation Corp., Tokyo (JP)

(72) Inventor: Michiaki Kaneko, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 30 days.

(21) Appl. No.: 17/558,489

(22) Filed: Dec. 21, 2021

(65) Prior Publication Data

US 2023/0055883 A1 Feb. 23, 2023

(30) Foreign Application Priority Data

Aug. 23, 2021 (JP) ..... 2021-135258

(51) Int. Cl.

| | |
|---|---|
| ***B65D 19/44*** | (2006.01) |
| ***B65D 19/40*** | (2006.01) |
| ***B65D 71/00*** | (2006.01) |
| ***B65D 81/07*** | (2006.01) |
| ***B65D 81/36*** | (2006.01) |

(52) U.S. Cl.

CPC ..... *B65D 19/40* (2013.01); *B65D 71/0092* (2013.01); *B65D 81/07* (2013.01); *B65D 81/36* (2013.01); *B65D 2571/00074* (2013.01); *B65D 2571/00086* (2013.01)

(58) Field of Classification Search

CPC .. B65D 19/44; B65D 19/003; B65D 19/0077; B65D 2519/00815; B65D 2519/00437; B65D 2519/0084; B65D 2519/000288; B65D 2519/00293

See application file for complete search history.

(56) References Cited

U.S. PATENT DOCUMENTS 4,375,261 A * 3/1983 Kitchell ..... B65D 5/5035 206/592
2002/0056386 A1* 5/2002 Sekino ..... B65D 19/44 101/368

FOREIGN PATENT DOCUMENTS

| | | | |
|---|---|---|---|
| DE | 4119363 A1 * | 2/1993 | ..... B65D 19/0026 |
| DE | 202009016816 U1 * | 4/2010 | ..... B65D 19/0026 |
| JP | H07205989 | 8/1995 | |
| JP | 2000296833 | 10/2000 | |
| JP | 2002104395 | 4/2002 | |
| TW | 201103840 A * | 2/2011 | ..... B65D 5/10 |

OTHER PUBLICATIONS

DE_4119363_A1_translation.pdf (Year: 1993).*

* cited by examiner

*Primary Examiner* — Allan D Stevens

(74) *Attorney, Agent, or Firm* — JCIPRNET

(57) ABSTRACT

A shock-absorbing structure includes an underlay placed on a base, and a cushioning member disposed on the underlay. The underlay includes at least one positioning portion that includes a slope raised in a position inclined with respect to another area of the positioning portion and fixes the cushioning member in position, and a support portion that supports the slope in an obliquely raised position. The cushioning member includes at least one hollow that receives the positioning portion.

16 Claims, 8 Drawing Sheets

SHOCK-ABSORBING STRUCTURE AND TRANSPORTATION PALLET

CROSS-REFERENCE TO RELATED APPLICATIONS

This application is based on and claims priority under 35 USC 119 from Japanese Patent Application No. 2021-135258 filed Aug. 23, 2021.

BACKGROUND

(i) Technical Field

The present disclosure relates to a shock-absorbing structure and a transportation pallet.

(ii) Related Art

A known transportation pallet has a structure where corrugated fiberboard is placed on a wooden pallet, a cushioning member made of, for example, expanded polystyrene is disposed on the corrugated fiberboard, and a product such as a device to be transported is placed on the cushioning member. To receive the product such as a device to be transported at an accurate position, such a transportation pallet with this structure has to have the cushioning member fixed in position. Japanese Unexamined Patent Application Publication No. 7-205989, No. 2000-296833, and No. 2002-104395 disclose positioning structures where corrugated fiberboard has holes, and protrusions included in a cushioning member are received in the holes of the corrugated fiberboard.

SUMMARY

A transportation pallet with the above structure may receive a lateral force when hitting against any obstacle during transportation. In this case, upon receipt of the lateral force, the cushioning member may be displaced together with the product such as a transported device, and the protrusions of the cushioning member received in the holes of the corrugated fiberboard may be torn. The torn pieces of the protrusions of the cushioning member may enter the product such as a transported device and adversely affect the operation of the product. To address this, the cushioning member is to be prevented from being torn regardless of when being displaced.

Aspects of non-limiting embodiments of the present disclosure relate to a shock-absorbing structure and a transportation pallet including a cushioning member fixed in position, and where, compared to a structure where protrusions of a cushioning member are received in holes in corrugated fiberboard, components are prevented from being partially torn regardless of when the cushioning member receives a lateral force.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a shock-absorbing structure including an underlay placed on a base, and a cushioning member disposed on the underlay, wherein the underlay includes at least one positioning portion that includes a slope raised in a position inclined with respect to another area of the positioning portion and fixes the cushioning member in position, and a support portion that supports the slope in an obliquely raised position, and wherein the cushioning member includes at least one hollow that receives the positioning portion.

BRIEF DESCRIPTION OF THE DRAWINGS

Exemplary embodiments of the present disclosure will be described in detail based on the following figures, wherein.

DETAILED DESCRIPTION

First, a comparative example compared with exemplary embodiments of the disclosure will be described below, and then, exemplary embodiments of the disclosure will be described.

Figure 1A:
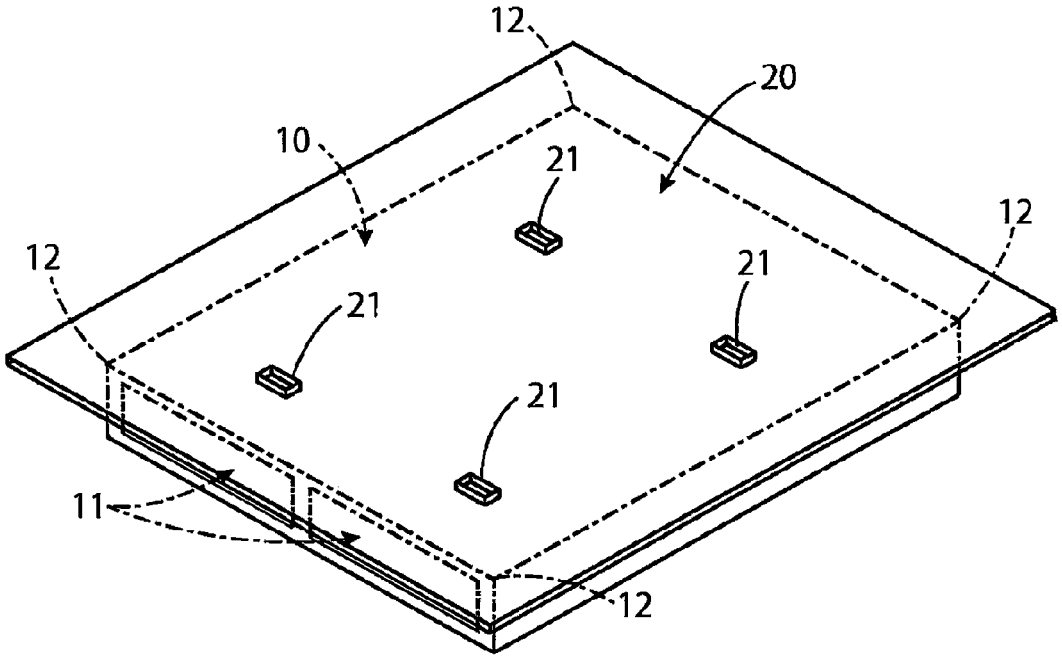
FIGS. 1A and 1B are schematic diagrams of a transportation pallet according to a comparative example.
Figure 1B:
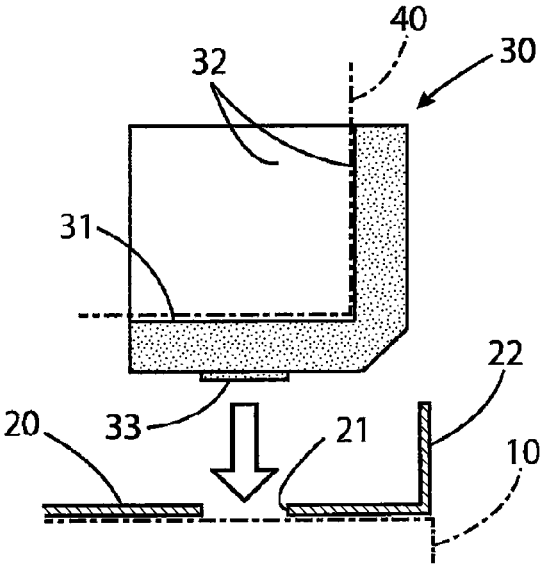

FIGS. 1A and 1B are schematic diagrams of a transportation pallet according to a comparative example. This transportation pallet has a shock-absorbing structure according to a comparative example.

As illustrated in FIG. 1A, a corrugated fiberboard piece 20 with an area larger than a pallet 10 is placed on the pallet 10. The pallet 10 has spaces 11 that allow forks of a forklift (not illustrate) to be inserted thereinto. The corrugated fiberboard piece 20 placed on the pallet 10 has four holes 21 at positions slightly inward from four corners 12 of the pallet 10. Although FIG. 1A illustrates the state where the corrugated fiberboard piece 20 in a flat shape is placed on the pallet 10, the edge portion of the corrugated fiberboard piece 20 extending beyond the pallet 10 is folded upward as illustrated in FIG. 1B to form an erect wall 22. Thus, the corrugated fiberboard piece 20 forms a dish shape as a whole.

A cushioning member 30 made of, for example, expanded polystyrene is placed on the corrugated fiberboard piece 20. The cushioning member 30 includes a base portion 31 and a wall 32 standing erect from the base portion 31, and the wall 32 is disposed along the erect wall 22 of the corrugated fiberboard piece 20 at the corners of the pallet 10. The cushioning member 30 includes protrusions 33 on the under-side, and the protrusions 33 are fitted into the holes 21 formed in the corrugated fiberboard piece 20. Then, a product 40, which is an object to be transported, is placed on the base portion 31 of the cushioning member 30 placed on the corrugated fiberboard piece 20, and the four corners at the bottom of the product 40 are protected by the cushioning member 30.

Assume a case where, for example, a strong horizontal force that is unbearable for the corrugated fiberboard piece 20 of the comparative example is applied to the product 40 during transportation with a forklift. In this case, the cushioning member 30 is pushed by the product 40 to move in the direction. At this time, the protrusions 33 may be torn.

Although not illustrated, in contrast to the comparative example illustrated above, in another conceivable structure, the corrugated fiberboard piece 20 may include cut pieces standing upright, and the cushioning member 30 has slits that receive the cut pieces. However, in this structure, the cut pieces of the corrugated fiberboard piece 20 received in the cushioning member 30 may be torn.

Exemplary embodiments described below have structures that prevent such pieces from being torn.

Figure 2A:
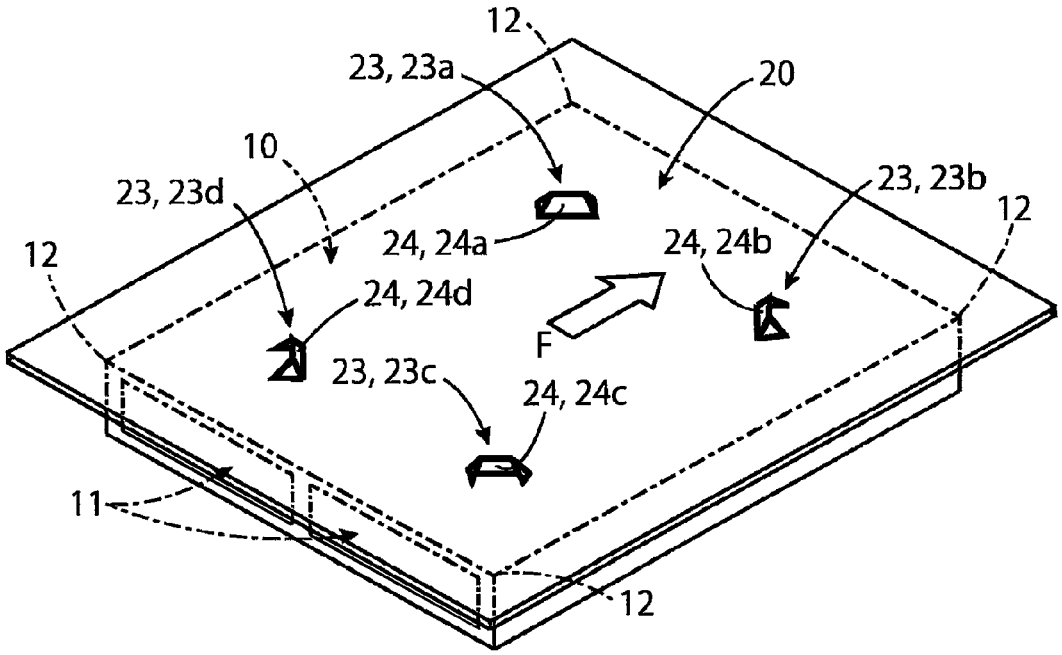
FIGS. 2A and 2B are schematic diagrams of a transportation pallet according to an exemplary embodiment of the present disclosure.
Figure 2B:
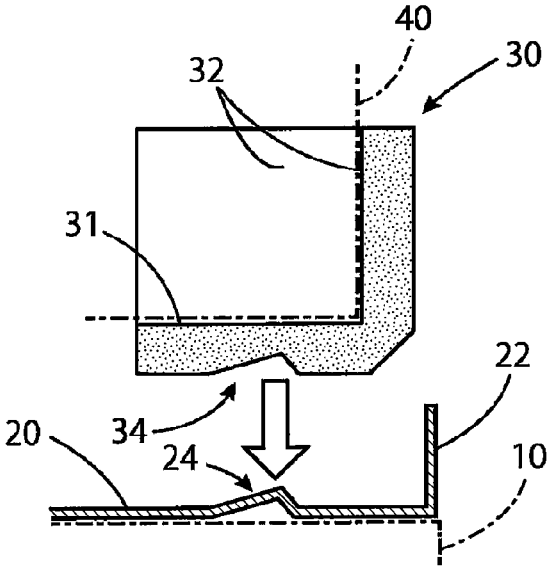

FIGS. 2A and 2B are schematic diagrams of a transportation pallet according to an exemplary embodiment of the disclosure. Components corresponding to those of the transportation pallet according to the comparative example illustrated in FIGS. 1A and 1B are denoted with the same reference signs, and may not be described.

A corrugated fiberboard piece 20 is placed on a pallet 10. An edge portion of the corrugated fiberboard piece 20 is folded upward to form an erect wall 22, and the corrugated fiberboard piece 20 has a dish shape as a whole. The corrugated fiberboard piece 20 includes four positioning portions 23 at positions slightly inward from four corners 12 of the pallet 10 to fix the position of the cushioning member. These positioning portions 23 include slopes 24 (24*a*, 24*b*, 24*c*, 24*d*) raised in a position inclined with respect to another area. The slope 24 forming each positioning portion 23 is raised in a position leaning toward the closest one of the four corners 12 of the pallet 10. The detailed structure of each positioning portion 23 including the slope 24 will be described later.

The cushioning member 30 has, at the bottom, positioning holes 34 that are recessed to receive the positioning portions 23 of the corrugated fiberboard piece 20. When the cushioning member 30 is placed on the corrugated fiberboard piece 20 while receiving the positioning portions 23 of the corrugated fiberboard piece 20 in the positioning holes 34, the cushioning member 30 is fixed in position. Then, the product 40 is placed on the cushioning member 30 fixed in position.

For example, assume a case where, a strong horizontal force that is unbearable for the erect wall 22 of the corrugated fiberboard piece 20 is applied to the product 40 during transportation with a forklift. In this case, the cushioning member 30 is pushed by the product 40 to move. At this time, a force in the same direction is also applied to the positioning portions 23 of the corrugated fiberboard piece 20 received in the positioning holes 34 of the cushioning member 30. The positioning portions descried below have a structure that is less easily torn regardless of receiving such a force.

The pallet 10 corresponds to an example of a base in the disclosure, and the corrugated fiberboard piece 20 corresponds to an example of an underlay in the disclosure.

The positioning portions will be described now.

Figure 3A:
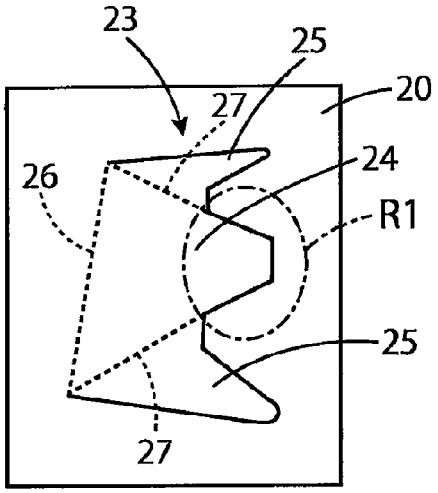
FIGS. 3A to 3C are diagrams illustrating the procedure of manufacturing a positioning portion according to a first example.
Figure 3B:
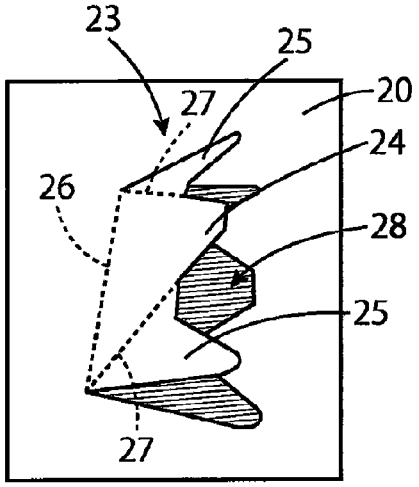
Figure 3C:
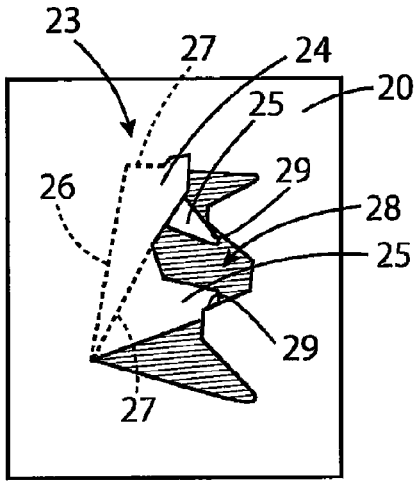

FIGS. 3A to 3C are diagrams illustrating the procedure of manufacturing the positioning portions according to a first example.

FIGS. 3A to 3C illustrate one positioning portion 23, and a portion of the corrugated fiberboard piece 20 surrounding the positioning portion 23. Here, an unformed or in-process portion is also referred to as a positioning portion 23. The solid line of the positioning portion 23 denotes a cutting-plane line or to-be cutting-plane line (illustrated as a cutting-plane line), and the dotted lines denote folding lines or to-be folding lines (illustrated as folding lines).

FIG. 3A illustrates an uncut cutting-plane line or a to-be cutting-plane line of the positioning portion 23. A trapezoidal portion at the center forms a slope 24, and portions on both sides of the trapezoidal portion form folded pieces 25. The slope 24 and the folded pieces 25 on both sides are integrally cut and raised.

The corrugated fiberboard piece 20 is cut along the solid line illustrated in FIG. 3A. In this first example, a portion encircled with a circle R1 is cut into a trapezoid. After being cut, the portion is folded along a folding line 26, and, as illustrated in FIG. 3B, the positioning portion 23 is cut and raised obliquely to the other portion of the corrugated fiberboard piece 20. After being cut and raised, the corrugated fiberboard piece 20 has a hole 28 illustrated with hatching.

Then, as illustrated in FIG. 3C, the folded pieces 25 on both sides of the slope 24 are folded along folding lines 27. The folded pieces 25 are folded at an acute angle with respect to the slope 24. The folded pieces 25 formed by folding are hooked on edges 29 of the hole 28 formed in the corrugated fiberboard piece 20. The edges 29 and the hole 28 are formed by raising the slope 24. When the folded pieces 25 are hooked on the edges 29 of the hole 28, the slope 24 is supported in an obliquely raised position. In this example, a combination of the folded pieces 25 and edges 29 on which the folded pieces 25 are hooked corresponds to an example of a support portion in the disclosure that supports the slope 24 in an obliquely raised position.

In this example, the folded pieces 25 are disposed on both sides of the slope 24. Thus, compared to a case where the folded piece 25 is disposed on only one side, this structure stably retains the angle of the slope 24.

Figure 4:
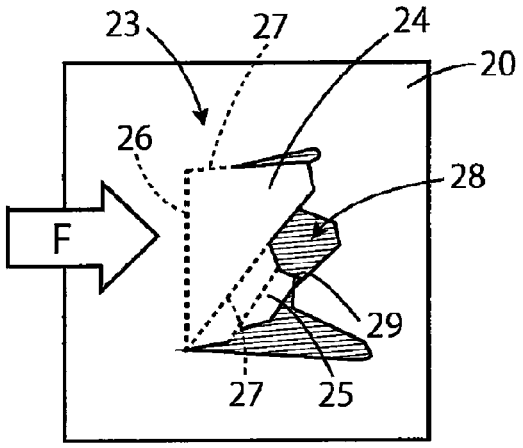
FIG. 4 is a schematic diagram of the behavior of the positioning portion according to the first example illustrated in FIGS. 3A to 3C when the positioning portion receives a lateral force.

FIG. 4 is a schematic diagram illustrating the behavior of the positioning portion according to the first example illustrated in FIGS. 3A to 3C when the positioning portion receives a lateral force.

Assume a case where a force in a direction indicated with arrow F, that is, in a direction in which the slope 24 is further inclined is applied. At this time, the folded pieces 25 on both sides of the slope 24 are folded down and collapsed to press down the slope 24 into an approximately flat position. Thus, a force of pressing down the slope 24 is exerted on the positioning portion 23, and thus the positioning portion 23 is substantially prevented from being torn and separated from the corrugated fiberboard piece 20. Regardless of when each positioning portion 23 receives a force in a direction of pressing down the slope 24 that is inclined further than arrow F indicated here, although the folded pieces 25 are crushed differently between the left and right sides, the positioning portion 23 is substantially prevented from being torn and separated from the corrugated fiberboard piece 20.

As described above, as illustrated in FIGS. 2A and 2B, the slope 24 of each positioning portion 23 is inclined toward the corner 12 of the pallet 10 closest to the positioning portion 23. The cushioning member 30 is disposed on the positioning portions 23 while the positioning portions 23 are received in the positioning holes 34 of the cushioning member 30, and the product 40 is placed on the cushioning member 30.

Assume a case where, for example, a force in the direction of arrow F illustrated in FIG. 2A is applied. In this case, a force of pressing down slopes 24*a* and 24*b* are exerted on the slopes 24*a* and 24*b* of two positioning portions 23*a* and 23*b* among the four positioning portions 23 disposed on the forward side in the direction of arrow F, so that the positioning portions 23*a* and 23*b* are prevented from being torn although having the folded pieces 25 crushed. On the other hand, when a force in the direction of arrow F is applied, two positioning portions 23*c* and 23*d* disposed on the rearward side in the direction of arrow F allow only the product 40 to move in the direction of arrow F while leaving the cushioning member 30 disposed on the positioning portions 23*c* and 23*d* at the position unchanged. Thus, these positioning portions 23*c* and 23*d* are also prevented from being torn.

Figure 5A:
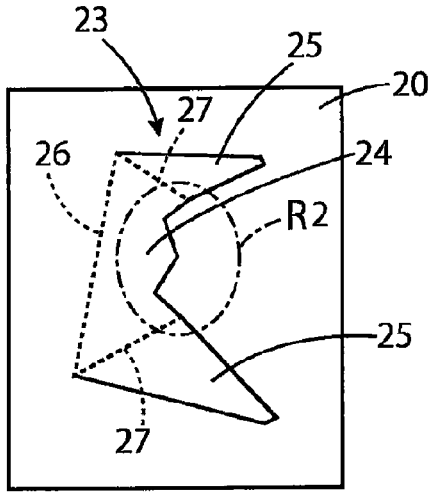
FIGS. 5A to 5C are diagrams illustrating the procedure of manufacturing a positioning portion according to a second example.
Figure 5B:
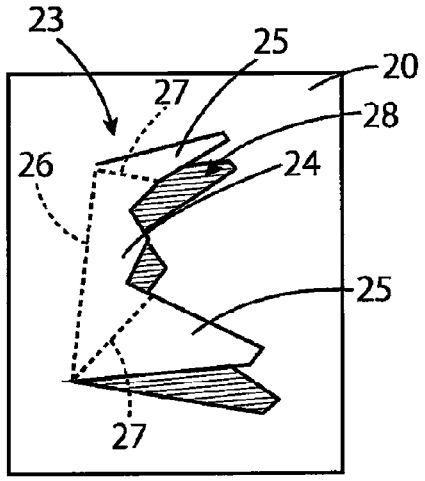

FIGS. 5A and 5B are diagrams illustrating the procedure of manufacturing a positioning portion according to a second example.

As in the case of FIGS. 3A, 3B, and 3C, FIGS. 5A and 5B illustrate one positioning portion 23 and a portion of the corrugated fiberboard piece 20 surrounding the positioning portion 23. As in the case of the first example, an unformed or in-process portion is also referred to as a positioning portion 23. The solid line of the positioning portion 23 denotes a cutting-plane line or to-be cutting-plane line (illustrated as a cutting-plane line), and the dotted lines denote folding lines or to-be folding lines (illustrated as folding lines).

FIG. 5A illustrates an uncut cutting-plane lines and folding lines of the positioning portion 23. In contrast to the first example where the portion encircled with a circle R1 in FIG. 3A is cut into a trapezoid, in this second example, a portion encircled with a circle R2 in FIG. 5A is cut in a triangle or in a zigzag shape. A portion including a zigzag-cut profile forms the slope 24, and the portions on both sides of the slope 24 form folded pieces 25. Also in the second example, the slope 24 and the folded pieces 25 on both sides of the slope 24 are integrally cut.

After being cut, the portion is folded along a folding line 26, and, as illustrated in FIG. 5B, cut and raised obliquely to the other portion of the corrugated fiberboard piece 20. After this portion is cut and raised, the corrugated fiberboard piece 20 has a hole 28 illustrated with hatching.

Figure 5C:
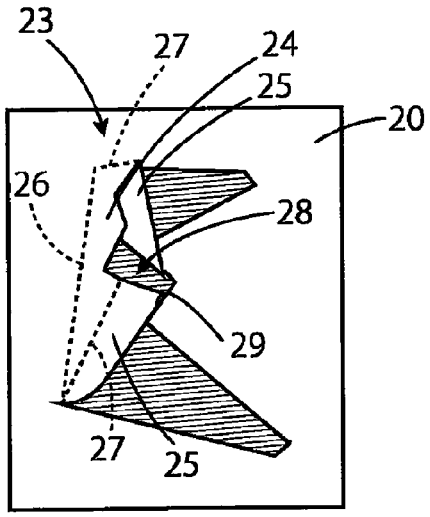

Then, as illustrated in FIG. 5C, the folded pieces 25 on both sides of the slope 24 are folded along folding lines 27. The folded pieces 25 are folded at an acute angle, with respect to the slope 24, less than the acute angle in the first example. The folded pieces 25 formed by folding are hooked on an edge 29 of the hole 28 formed in the corrugated fiberboard piece 20. The edge 29 and the hole 28 are formed by raising the slope 24. The edge 29 has a triangular valley shape at the middle. When the folded pieces 25 are hooked on the edge 29 of the hole 28, the slope 24 is supported in an obliquely raised position. Also in the second example, a combination of the folded pieces 25 and the edge 29 on which the folded pieces 25 are hooked corresponds to an example of a support portion in the disclosure.

Figure 6A:
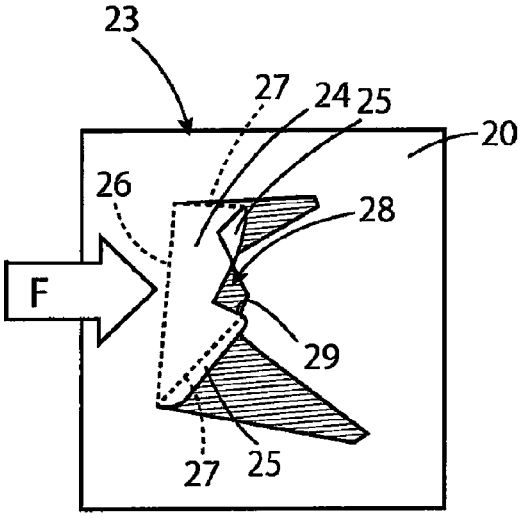
FIGS. 6A and 6B are schematic diagrams of the behavior of the positioning portion according to the second example illustrated in FIGS. 5A to 5C when the positioning portion receives a lateral force.
Figure 6B:
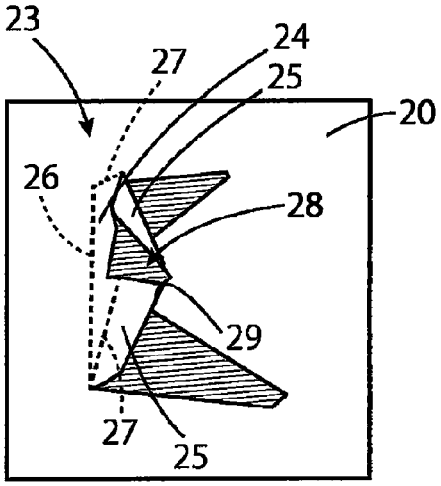

FIGS. 6A and 6B are schematic diagrams illustrating the behavior of the positioning portion according to the second example illustrated in FIGS. 5A to 5C when the positioning portion receives a lateral force.

Again assume a case where a force in a direction indicated with arrow F, that is, in a direction in which the slope 24 is further inclined is applied. At this time, as illustrated in FIG. 6A, the folded pieces 25 on both sides of the slope 24 are further folded to further press down the slope 24 into an approximately flat position. In this case, the folded pieces 25 are usually folded into a narrower acute angle, but not less likely to be irregularly crushed unlike in the first example. Thus, in the second example, as illustrated in FIG. 6B, the slope 24 and the folded pieces 25 are restorable to the original position to be reusable.

Figure 7:
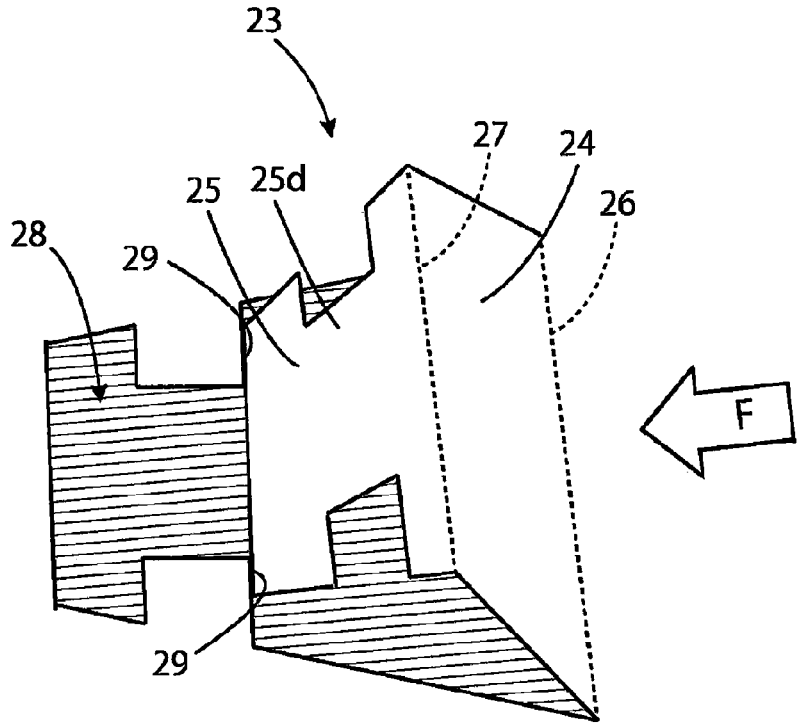
FIG. 7 is a schematic diagram of a positioning portion according to a third example.

FIG. 7 is a schematic diagram of a positioning portion according to a third example.

A folded piece 25 in a positioning portion 23 according to the third example is cut into a shape including a narrow portion 25*d* having a small width, and raised along the folding line 26. Then, the folded piece 25 is folded along the folding line 27, and the end portions of the folded piece 25 are hooked on edges 29 of the hole 28 partially forming the narrow portion 25*d*. In this third example, a combination of the folded piece 25 and the edges 29 of the hole 28 on which the end portions of the folded piece 25 are hooked corresponds to an example of a support portion in the disclosure. The degree of the slope 24 to fall when receiving a force in the direction of arrow F is adjusted by changing, for example, the width or length of the narrow portion 25*d* of the folded piece 25.

Figure 8:
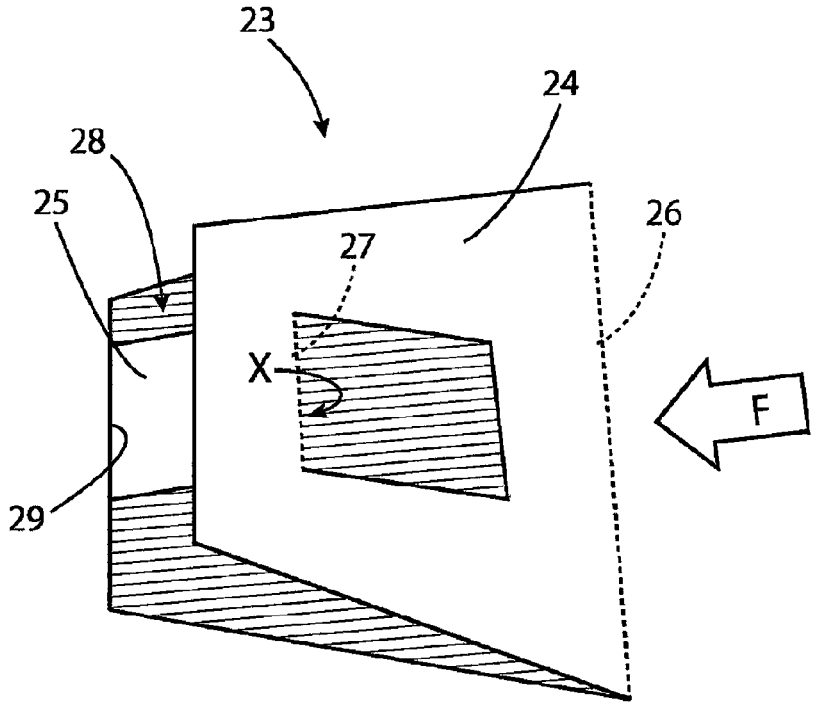
FIG. 8 is a schematic diagram of a positioning portion according to a fourth example.

FIG. 8 is a schematic diagram illustrating a positioning portion according to a fourth example.

The positioning portion 23 according to a fourth example is cut in a trapezoid while leaving a side along the folding line 26 uncut, and at the same time, cut into a rectangular while leaving a side along the folding line 27 uncut. Then, the positioning portion 23 is raised along the folding line 26, and the folded piece 25 is folded along the folding line 27 back in a direction of arrow X, and the end portion of the folded piece 25 is hooked on the edge 29 of the hole 28. In the fourth example, a combination of the folded piece 25 and the edge 29 of the hole 28 on which the end portion of the folded piece 25 is hooked corresponds to an example of a support portion in the disclosure. The degree of the slope 24 to fall when receiving a force in the direction of arrow F is adjusted by changing, for example, the width or length of the folded piece 25.

Figure 9:
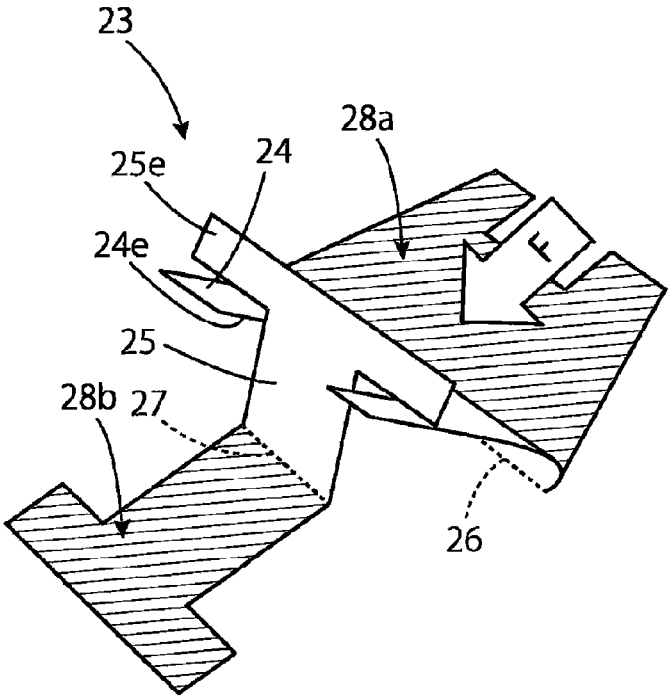
FIG. 9 is a schematic diagram of a positioning portion according to a fifth example.

FIG. 9 is a schematic diagram of a positioning portion according to a fifth example.

In the positioning portion 23 according to the fifth example, the slope 24 and the folded piece 25 are separately cut and raised to form two holes 28*a* and 28*b*. The slope 24 is cut in a shape having a recess 24*e* at the end in the middle, and folded along the folding line 26. On the other hand, the folded piece 25 is cut into a shape including a wide hook 25*e* at the end, and folded along the folding line 27. The hook 25*e* of the folded piece 25 is hooked on the recess 24*e* of the slope 24. Thus, the slope 24 is supported in an oblique position. In this fifth example, the folded piece 25 corresponds to an example of a support portion in the present disclosure.

The above exemplary embodiment of the disclosure provides a shock-absorbing structure and a transportation pallet capable of at least partially preventing pieces of components from being torn when receiving a lateral force while the cushioning member 30 is fixed in position.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A shock-absorbing structure, comprising:

an underlay configured to be placed on a base; and a cushioning member disposed on the underlay, wherein the underlay includes:

at least one positioning portion that includes a slope raised in a position inclined with respect to another area of the at least one positioning portion and fixes the cushioning member in position; and a support portion that supports the slope in an obliquely raised position, and wherein the cushioning member includes at least one hollow that receives the at least one positioning portion, wherein the support portion includes two folded pieces cut and raised integrally with the slope and folded with respect to the slope and an edge of a hole formed in the underlay by the cutting and raising, the edge coming into contact with one of the folded pieces, wherein the at least one folded piece includes two folded pieces respectively disposed on two sides of the slope.

2. The shock-absorbing structure according to claim 1, wherein the support portion further includes:

an edge of a hole formed in the underlay by the cutting and raising, the edge coming into contact with the at least one folded piece.

3. The shock-absorbing structure according to claim 2, wherein, when being folded in a direction to form an acute angle with respect to the slope and coming into contact with the edge, the one of the foldes pieces supports the slope in the obliquely raised position.

4. The shock-absorbing structure according to claim 1, wherein the slope is raised in a position leaning toward one of corners of the base closest to the slope.

5. The shock-absorbing structure according to claim 2, wherein the slope is raised in a position leaning toward one of corners of the base closest to the slope.

6. The shock-absorbing structure according to claim 3, wherein the slope is raised in a position leaning toward one of corners of the base closest to the slope.

7. The shock-absorbing structure according to claim 4, wherein the at least one positioning portion includes a plurality of positioning portions located at a plurality of positions apart from each other, and wherein the positioning portions are raised in a position leaning toward corners of the base closest to the positioning portions.

8. The shock-absorbing structure according to claim 5, wherein the at least one positioning portion includes a plurality of positioning portions located at a plurality of positions apart from each other, and wherein the positioning portions are raised in a position leaning toward corners of the base closest to the positioning portions.

9. The shock-absorbing structure according to claim 6, wherein the at least one positioning portion includes a plurality of positioning portions located at a plurality of positions apart from each other, and wherein the positioning portions are raised in a position leaning toward corners of the base closest to the positioning portions.

10. The shock-absorbing structure according to claim 1, wherein the underlay is a corrugated fiberboard piece.

11. The shock-absorbing structure according to claim 2, wherein the underlay is a corrugated fiberboard piece.

12. The shock-absorbing structure according to claim 3, wherein the underlay is a corrugated fiberboard piece.

13. The shock-absorbing structure according to claim 4, wherein the underlay is a corrugated fiberboard piece.

14. The shock-absorbing structure according to claim 5, wherein the underlay is a corrugated fiberboard piece.

15. The shock-absorbing structure according to claim 6, wherein the underlay is a corrugated fiberboard piece.

16. A transportation pallet, comprising:

the shock-absorbing structure according to claim 1; and a pallet that includes:

a wooden mount; and a space that is disposed under the wooden mount to receive forks of a forklift.

* * * * *